US005443119A

United States Patent [19]

Chambers et al.

[11] Patent Number: 5,443,119

[45] Date of Patent: Aug. 22, 1995

[54] METHOD FOR CONTROLLING SAND PRODUCTION FROM A HYDROCARBON PRODUCING RESERVOIR

[75] Inventors: Michael R. Chambers, Bedford; Eve S. Sprunt, Farmers Branch, both of Tex.

[73] Assignee: Mobil Oil Corporation, Fairfax, Va.

[21] Appl. No.: 282,375

[22] Filed: Jul. 29, 1994

[51] Int. Cl.[6] ..... E21B 43/119; E21B 49/00

[52] U.S. Cl. ..... 166/254; 166/297

[58] Field of Search ..... 166/250, 254, 281, 297, 166/298

[56] References Cited

U.S. PATENT DOCUMENTS

| | | | |
|---|---|---|---|
| 3,369,626 | 2/1968 | Zemanek, Jr. . | |
| 3,668,619 | 6/1972 | Dennis | 340/15.5 |
| 3,718,204 | 2/1973 | Groenendyke | 181/181 |
| 3,728,672 | 4/1973 | Dennis et al. | 340/15.5 |
| 4,378,845 | 4/1983 | Medlin et al. | 166/297 |
| 4,542,488 | 9/1985 | Clishem et al. | 367/35 |
| 4,631,963 | 12/1986 | Sprunt et al. | 73/594 |
| 4,631,964 | 12/1986 | Sprunt et al. | 73/594 |
| 4,713,968 | 12/1987 | Yale | 73/594 |
| 4,744,245 | 5/1988 | White | 166/250 X |
| 4,953,137 | 8/1990 | Medlin | 36/31 |
| 5,259,466 | 11/1993 | Venditto et al. | 166/297 X |
| 5,318,123 | 6/1994 | Venditto et al. | 166/250 |
| 5,335,724 | 8/1994 | Venditto et al. | 166/250 X |

OTHER PUBLICATIONS

S. Prensky, Breakouts and In-situ Rock Stress, pp. 304–312 by the Log Analyst, May-Jun. 1992.

L. Mastin Effect of Borehole Deviation on Breakout Orientations, pp. 9187–9195, Journal of Geophysical Research, Aug. 10, 1988, vol. 93.

D. Moos et al., Utilization of Observations of Well Bore Failure to Constrain the Orientation and Magnitude of Crustal Stresses; pp. 9305–9325, vol. 95, Journal of Geophysical Research, Jun. 10, 1990.

Zoback et al., Wellbore Breakouts and in Situ Stress, pp. 5523–5530, Journal of Geophysical Research, vol. 90, Jun. 10, 1985.

Composite Catalog of Oil Field Equipment & Services, Published by World Oil, 34th. Revision, vol. 2, pp. 2130–2132, 1980–1981. See Also vol. 3, pp. 5193–5202, and vol. 4, p. 6084.

*Primary Examiner*—George A. Suchfield

*Attorney, Agent, or Firm*—Alexander J. McKillop; George W. Hager, Jr.

[57] ABSTRACT

In a hydrocarbon-producing well penetrating an unconsolidated hydrocarbon reservoir, the azimuthal direction of the maximum in-situ horizontal compressive stress within the reservoir having non-uniform horizontal tectonic stresses surrounding the well is determined. Perforations are formed in the reservoir, or in the casing if the well is cased, oriented in the azimuthal direction of the determined maximum in-situ horizontal compressive stress. Thereafter, hydrocarbon production is initiated from the well through the perforations whereby the potential for sand production along with produced hydrocarbons is minimized.

6 Claims, 3 Drawing Sheets

METHOD FOR CONTROLLING SAND PRODUCTION FROM A HYDROCARBON PRODUCING RESERVOIR

BACKGROUND OF THE INVENTION

In the production of hydrocarbons from hydrocarbon-bearing unconsolidated formations, a well is provided which extends from the surface of the earth into the unconsolidated, or poorly consolidated formation. The well may be completed by employing conventional completion practices, such as running and cementing casing in the well and forming perforations through the casing and cement sheath surrounding the casing, thereby forming an open production interval which communicates with the formation.

The production of hydrocarbons from unconsolidated or poorly consolidated formations may result in the production of sand along with the hydrocarbons. Produced sand is undesirable for many reasons. It is abrasive to components within the well, such as tubing, pumps and valves, and must be removed from the produced fluid at the surface. It may partially or completely clog the well, thereby making necessary an expensive workover. In addition, the sand flowing from the formation may leave therein a cavity which may result in collapsing of the casing.

Probably the most widely-used technique to control the production of sand from a formation is known as gravel packing. A gravel pack is formed in the well adjacent to part or all of the unconsolidated or poorly consolidated formation exposed to the well. The gravel is sized so that it forms a permeable mass which allows flow of the produced hydrocarbons therethrough and into the well while blocking the flow of sand produced with the hydrocarbons. While gravel packing can effectively control sand production, it can reduce well productivity, increase well cost, and necessitate workovers.

SUMMARY OF THE INVENTION

The present invention is directed to a new and improved method for controlling sand production in a hydrocarbon-producing well penetrating an unconsolidated, or poorly consolidated, formation.

More particularly, the azimuthal direction of the maximum in-situ horizontal compressive stress within a hydrocarbon-bearing reservoir having non-uniform horizontal tectonic stresses surrounding a well is determined. Oriented perforations are then formed in the reservoirs surrounding the well. These perforations are oriented in the azimuthal direction of the determined maximum in-situ horizontal compressive stress. Thereafter hydrocarbon production is initiated from the reservoir into the well through the perforations, whereby the potential for production of sand along with hydrocarbons produced from the reservoir is minimized due to the orientation of the perforations within the reservoir in the direction of maximum in-situ horizontal compressive stress. If the well is cased, the perforations extend through such casing and into the reservoir.

In another aspect, existing perforations in well casing which are not oriented in the determined azimuthal direction of maximum in-situ horizontal compressive stress are squeezed off and new perforations are formed in the well casing oriented in such determined azimuthal direction. Hydrocarbon production is then initiated from the well through the new perforations whereby the potential for sand production is minimized due to the orientation of these new perforations in such determined azimuthal direction.

In a further aspect, perforations in the well casing that have been enlarged as a result of blasting by produced sand during hydrocarbon production are identified. These enlarged perforations are squeezed off and new perforations are formed in the well casing, oriented in the determined azimuthal direction of maximum in-situ horizontal compressive stress. Hydrocarbon production is then initiated from the well through the new perforations whereby the potential for sand production is minimized due to the orientation of these new perforations in such determined azimuthal direction.

In a still further aspect, a sand impact detecting device is lowered into a cased well to a position adjacent perforations within the hydrocarbon-producing reservoir. Hydrocarbon production is initiated and the presence of sand being produced along with hydrocarbons is detected from the impact of the sand on the impact detecting device. Perforations in the well casing through which sand is being produced as determined by such impact detecting device are squeezed off and new perforations are formed in the casing in the determined azimuthal direction of maximum in-situ horizontal compressive stress. Hydrocarbon production is then initiated from the well through the new perforations whereby the potential for sand production is minimized due to the orientation of these new perforations in such determined azimuthal direction.

DESCRIPTION OF THE PREFERRED EMBODIMENT

In accordance with the present invention, a wellbore is placed into a productive interval of a hydrocarbon-producing reservoir. Firstly, for a wellbore that has not yet been completed, if the reservoir can be expected under hydrostatic stress conditions to be able to withstand the hydrodynamic forces associated with producing hydrocarbons at the desired rate but is in a region of tectonic stress sufficiently high to weaken the formation at the stress concentrations around the wellbore, the azimuthal direction of in-situ stress can be determined by any of several conventional methods.

Figure 1:
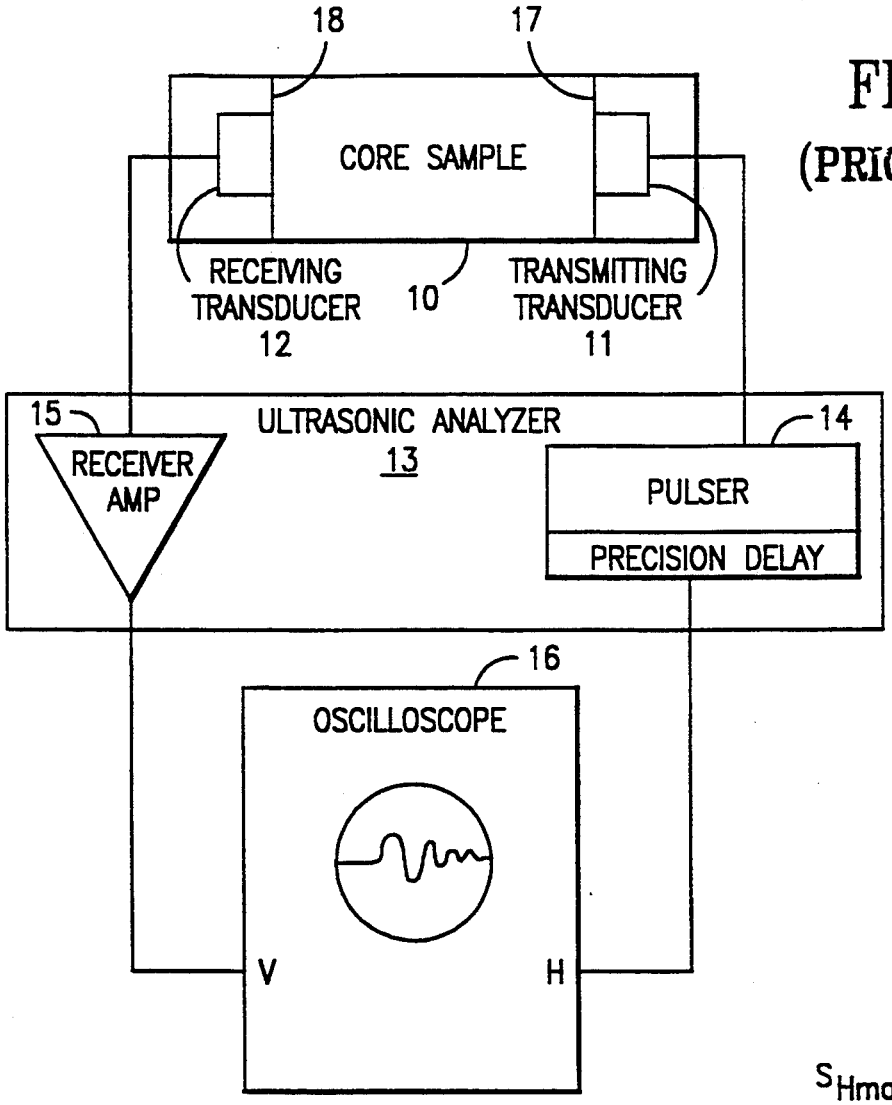
FIG. 1 (PRIOR ART)
FIG. 1 illustrates a conventional system for measuring changes in acoustic energy properties in a subterranean formation core sample which indicate the presence of lateral mechanical anisotropy in the core sample due to fractures, stress and other factors within the subterranean formation.

In U.S. Pat. Nos. 4,631,963 to Sprunt and Smallwood there is described a method for measuring changes in acoustic velocity, attenuation, waveform or other acoustic properties which indicate the presence of lateral mechanical anisotropy in a core sample due to fractures, stress and other factors within a subterranean formation. Referring to FIG. 1 compressional or shear acoustic energy is transmitted through the core sample 10 from a transmitting transducer 11 to a receiving transducer 12 that is perpendicular to a pair of parallel, planar outer surfaces 17 and 18 of the core sample 10. Thereafter, such acoustic energy is transmitted through each of the plurality of differing azimuthal directions that are perpendicular to the plurality of parallel, planar surfaces of the core sample.

Acoustic energy properties of the core sample 10 are measured by the ultrasonic analyzer 13, including the pulser 14 and receiver amplifier 15, and the oscilloscope 16. The measured acoustic properties are compared to identify the azimuthal direction of any acoustic energy anisotropy through the core sample. Such acoustic property measurements may be carried Out for paths of travel of the acoustic energy in each of the azimuthal directions through the core sample. Similar teachings are set forth in U.S. Pat. No. 4,631,964 to Sprunt and Smallwood as well as in U.S. Pat. No. 4,713,968 to Yale. Yale, in particular, teaches that amplitude and phase measurements of a cross-polarized shear acoustic energy transmitter and receiver are used to identity the azimuthal direction of mechanical anisotropy through a core sample.

Another teaching in U.S. Pat. No. 4,953,137 to Medlin describes the application of the measurement of variations in casing tube waves as they travel along the well casing to identification of the maximum and minimum in-situ horizontal compressive earth stresses around a wellbore. Accordingly, the teachings of U.S. Pat. Nos. 4,631,963; 4,631,964; 4,713,968 and 4,953,137 are incorporated herein by reference.

Further, the identification of borehole breakouts as a method for in-situ measurement of stress orientation is described in detail in i) "Borehole Breakouts and In-Situ Rock Stress", by the Log Analyst, May–June 1992, pg. 304–312, ii) "Effect of Borehole Deviation on Breakout Orientations", by Mastin, Journal of Geophysical Research, Aug. 10, 1988, Vol. 93, pgs. 9187–9195 and iii) "Utilization of Observations of Wellbore Failure to Constrain the Orientation and Magnitude of Crustal Stresses" by Moor and Zaback, Journal of Geophysical Research, Jun. 10, 1990, Vol 95, pgs. 9305–9325, the teachings of which are incorporated herein by reference.

In addition to the above methods, strain relaxation measurements on core samples or information from adjacent producing wells may also be used to determine the azimuthal direction of the maximum in-situ horizontal compressive stress.

Figure 2:
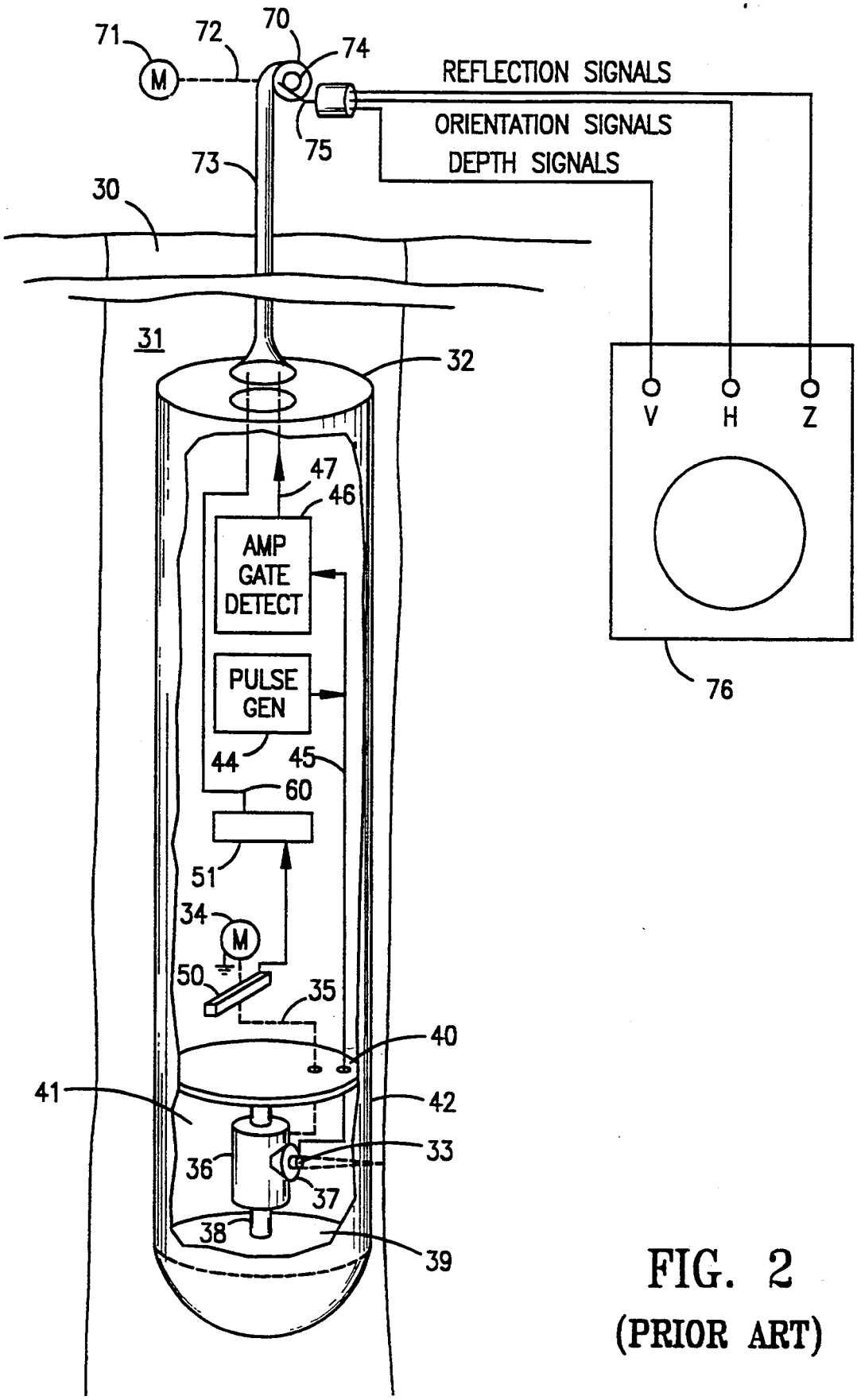
FIG. 2 (PRIOR ART)
FIG. 2 illustrates a conventional borehole televiewer system which produces a CRT display of scanning operations of the borehole wall or well casing wall by logging the amplitudes of acoustic energy reflections from the wall. Such a log could detect perforation enlargement as a result of sand production.

Secondly, for a previously completed well, wireline methods can be used to determine whether sand is being produced through well casing perforations at specific azimuthal orientations, thereby indicating the azimuth of formation weakness or minimum in-situ horizontal compressive stress. One such method utilizes a borehole televiewer to produce a CRT display of scanning operations of the casing wall by logging the amplitudes of acoustic energy reflections from the casing wall. Such borehole televiewers are described in detail in U.S. Pat. Nos. 3,369,626; 3,668,619; 3,718,204; 3,728,672 and 4,542,488 for example, the teachings of which are incorporated herein by reference. More particularly, and referring to FIG. 2, borehole 30 containing a borehole fluid 31 is traversed by a borehole logging tool 32. An acoustic transducer 33 is located within tool 32 and acts as a transmitter and receiver of acoustic energy. During logging operations the transducer 33 is rotated through 360° by motor 34, mechanical drive 35 (illustrated in detail in U.S. Pat. No. 3,378,097), sleeve 36, and transducer mount 37. The sleeve 36 rotates about mandrel which connects end member 39 to structure 40. In one embodiment, the transducer is rotated at a rate of about 3 to 6 Hertz. During each 360° cycle, the transducer 33 is pulsed periodically, in one embodiment, at a rate of about 2000 pulses per second for the application of acoustic pulses to the borehole wall by way of tool fluid 41, rubber boot and the borehole fluid 31. The predominant frequency of the acoustic pulses may be of the order of 1.35 megahertz. Pulse generator 44, which is coupled to transducer 33 by way of conductor 45 and slip rings (not shown), periodically actuates the transducer 33 for the production of acoustic pulses. Between transmitted acoustic pulses, reflected energy is detected by the transducer 33 and applied to the surface by way of conductor 45; amplifier, gate and detector system 46; and cable conductor 47.

Coupled to mechanical drive 35 for rotation therewith is a magnetic north sensing means 50 which in turn is coupled to circuitry 51 which produces an orientation signal or pulse each time the transducer 33 passes magnetic north. This orientation pulse is applied to the surface by way of cable conductor 60.

During logging operations, drum 70, driven by motor 71 and connection 72, winds and unwinds the supporting cable 73 to move the tool 32 continuously through the borehole. At the surface, the various orientation, depth and reflection signals are taken from the cable conductors by way of slip rings and brushes illustrated respectively at 74 and 75 and applied to the CRT display 76 wherein the reflection signals from the casing wall serve to intensity modulate the electron beam of the CRT as it sweeps across the face of the display in accordance with the amplitudes of such reflections signals. If well casing perforations at a specific azimuthal orientation are displayed as being preferentially enlarged or deepened as a result of abrasion or blasting caused by sand production, then the azimuth of formation weakness or maximum in-situ horizontal compressive stress is identified.

Figure 3:
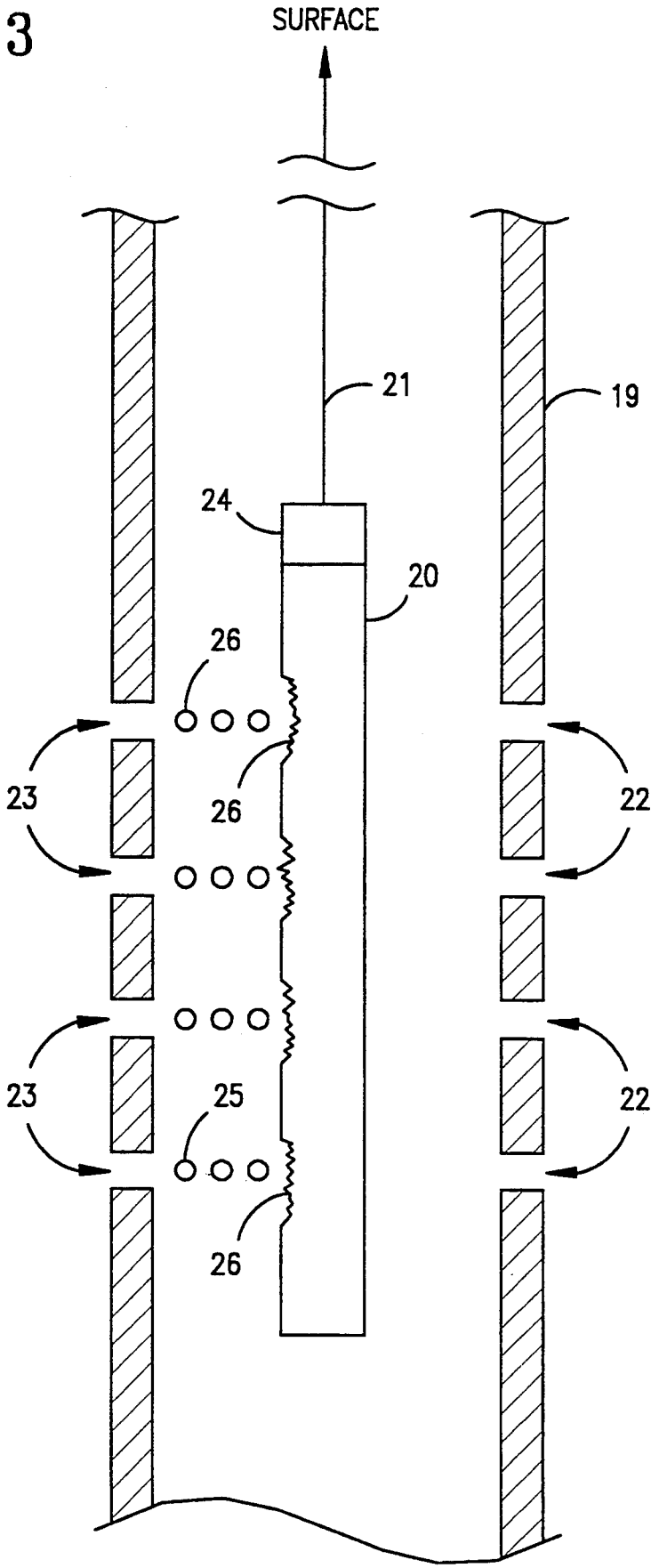
FIG. 3 illustrates a tube or rod positioned in juxtaposition to wellbore or well casing perforations upon which produced sand will impact and cause abrasive patterns indicative of such sand production.

Another method of determining which perforations are producing sand is shown in FIG. 3. A hollow tube or rod 20 is positioned by wireline 21 within the well casing 19 adjacent perforations 22 and 23 as shown in FIG. 3 and then production initiated. After a period of production flow, the tube 20 is retrieved from the well and examined to determine the abrasion patterns from any sand production. The orientation of such abrasion around the tube indicates which of the well casing perforations are producing sand. Such orientation can be determined from a gyro 24 associated with the tube 20. Consequently, FIG. 3 illustrates sand particles 25 entering the well through perforations 23 and impacting tube 20 to create a plurality of abrasions 26 in juxtaposition with perforations 23.

Having identified the azimuthal direction of reservoir in-situ horizontal compressive stresses in cased or uncased wells, the next step in the present invention is to create perforations in the reservoir surrounding the wellbore oriented in the azimuthal direction of the maximum in-situ horizontal compressive stress and initiate hydrocarbon production from the well through such newly created perforations. In this manner, the potential for sand production along with produced hydrocarbons from the reservoir is minimized due to the orientation of the perforations in the direction of such maximum in-situ horizontal compressive stress. If the well is cased, the perforations are created through the well casing into the reservoir. However, prior to perforating the well in such identified azimuthal direction of maximum in-situ horizontal compressive stress, it would be preferable to squeeze off any existing perforations not oriented in such azimuthal direction and through which sand production would occur.

Figure 4:
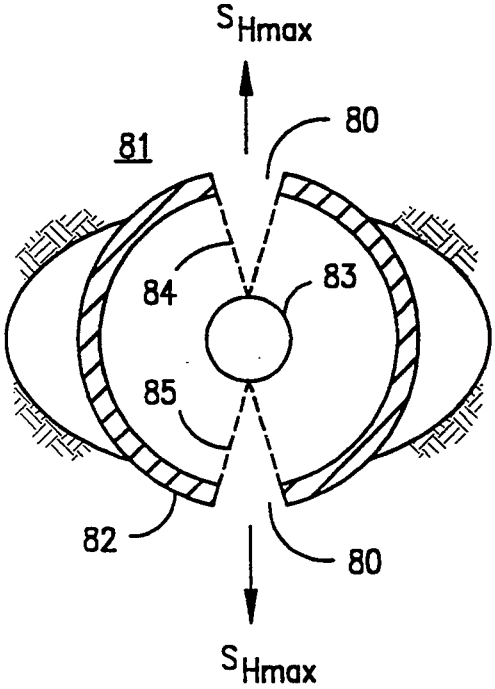
FIG. 4 illustrates a system for perforating a wellbore or well casing in-line with the azimuthal orientation of maximum in-situ horizontal compressive stress.

The perforating step is illustrated in FIG. 4. Perforation tunnels 80 are placed in the formation 81, and in the well casing 82 if the well is cased, by utilization of a conventional perforation gun 83 lowered into the well to a position adjacent the reservoir to be produced. The perforations are then made by in-line shots 84 and 85 using zero degree or 180° phasing which are aligned in the desired azimuthal orientation of maximum horizontal in-situ compressive stress $S_{Hmax}$. The Dia-Log Company, Box 2608, Houston, Tex. offers a complete selection of shaped charge or jet perforators. The jet perforator provides tremendous pressures of a high explosive detonation to squeeze a cone of dense material into a high speed jet in plastic flow. This jet washes a perforating tunnel through steel casing and cement into the formation surrounding the wellbore (see Composite Catalog of Oil Field Equipment & Services, Published by World Oil, 34th. Revision, Vol. 2, pgs. 2130–2132). A full line of retrievable and expendable jet perforating guns are also available from NL McCullough, P.O. Box 4305, Houston, Tex. (see Vol. 3, pgs. 5193–5202 of the above-referenced Composite Catalog) and from Pengo Industries, Inc., P.O. Box 40530, Ft. Worth, Tex. (see Vol. 4, pg 6084 of the above-referenced Composite Catalog). All these perforation guns are available for orienting or selective firing.

Having completed perforating the well, or well casing, in the azimuthal direction of the maximum in-situ horizontal compressive stress within the reservoir surrounding the well, hydrocarbon production is then initiated from the reservoir into the well through the perforations. In this way, the potential for sand production along with produced hydrocarbons from the reservoirs is minimized due to the orientation of the perforations in-line with the direction of maximum in-situ horizontal compressive stress.

We claim:

1. Method for controlling sand production in a hydrocarbon producing well, penetrating a subsurface hydrocarbon-bearing reservoir, comprising the steps of.

a) determining the azimuthal direction of the maximum in-situ horizontal compressive stress within a hydrocarbon-bearing reservoir having non-uniform horizontal tectonic stresses surrounding a well, b) forming perforations in the reservoir surrounding said well oriented in the azimuthal direction of the determined maximum in-situ horizontal compressive stress, and c) initiating hydrocarbon production from said well through said perforations, whereby the potential for sand production along with the production of hydrocarbons from said reservoir is minimized due to the orientation of said perforations within the reservoir in the direction of maximum in-situ horizontal compressive stress.

2. The method of claim 1 wherein said perforations are formed in said reservoir through well casing.

3. Method for controlling sand production in a hydrocarbon producing well employing perforated well casing, comprising the steps of:

a) determining the azimuthal direction of maximum in-situ horizontal compressive stress within a hydrocarbon-bearing reservoir having non-uniform horizontal tectonic stresses surrounding perforated well casing, b) squeezing off existing perforations in said well casing that are not oriented in the determined azimuthal direction of maximum in-situ horizontal compressive stress, c) forming new perforations in said well casing oriented in the determined azimuthal direction of a maximum in-situ horizontal compressive stress, and d) initiating hydrocarbon production from said well through said new perforations, whereby the potential for sand production along with the production of hydrocarbons from said reservoir is minimized due to the orientation of said new perforations within the reservoir in the direction of maximum in-situ horizontal compressive stress.

4. Method for controlling sand production in a hydrocarbon producing well employing perforated well casing penetrating a subsurface hydrocarbon bearing reservoir, comprising the steps of:

a) identifying perforations contained in said well casing that have been enlarged as a result of blasting by produced sand during hydrocarbon production, b) squeezing off perforations in said well casing that are determined in step (a) to have been producing sand during hydrocarbon production, c) forming new perforations in said well casing oriented in the azimuthal direction of maximum in-situ horizontal compressive stress within the reservoir surrounding the well, and d) initiating hydrocarbon production from said well whereby the potential for sand production along with the production of hydrocarbons form said reservoir is minimized due to the squeezing off of existing perforations in step (b) that have been producing sand and to the forming of new perforations in step (c) that are oriented in the azimuthal direction of maximum in-situ horizontal compressive stress within the reservoir.

5. Method for controlling sand production in a hydrocarbon producing well employing perforated well casing penetrating subsurface hydrocarbon-bearing reservoir, comprising the steps of:

a) identifying a depth interval within said hydrocarbon-bearing reservoir along which said well casing contains perforations enlarged as a result of blasting by produced sand during hydrocarbon production from said reservoir, b) squeezing off said enlarged perforations within said well casing along said identified depth interval, c) forming new perforations within said well casing along said identified depth interval and oriented in the azimuthal direction of maximum in-situ horizontal compressive stress within the reservoir surrounding the well, and d) initiating hydrocarbon production from said well whereby the potential for sand production along with the production of hydrocarbons from said reservoir is minimized due to the squeezing off existing perforations in step (b) that have been producing sand and to the forming of new perforations in step (c) that are oriented in the azimuthal direction of maximum in-situ horizontal compressive stress within the reservoir.

6. Method for controlling sand production in a producing well employing perforated well casing penetrating a hydrocarbon-bearing reservoir, comprising the steps of:

a) lowering a sand impact detecting device into said well to a position adjacent perforations in said well casing, b) initiating hydrocarbon production through said perforations, c) detecting the presence of sand being produced along with hydrocarbons from the impact of said sand on said impact detecting device, d) squeezing off perforations in said well casing that are determined in step (c) to be producing sand during hydrocarbon production, e) forming new perforations in said well casing oriented in the azimuthal direction of maximum in-situ horizontal compressive stress within the reservoir surrounding the well, and f) initiating hydrocarbon production from said well, whereby the potential for sand production along with the production of hydrocarbons from said reservoir is minimized due to the squeezing off of existing perforations in step (d) that have been producing sand and to the forming of new perforations in step (e) that are oriented in the azimuthal direction of maximum in-situ horizontal compressive stress within the reservoir.

* * * * *